US007557497B1

(12) United States Patent
Gibboney et al.

(10) Patent No.: US 7,557,497 B1
(45) Date of Patent: Jul. 7, 2009

(54) ASYMMETRIC MECHANICAL SHUNT SWITCH FOR USE IN A SOCKET OF A STRING OF LIGHTS

(75) Inventors: James W. Gibboney, Conyers, GA (US); Andy Kuo-An Pan, Kowloon (HK); Kao Bin Pan, Dong Guan (CN)

(73) Assignee: Tech Patent Licensing, LLC, St. Augustine, FL (US)

( * ) Notice: Subject to any disclaimer, the term of this patent is extended or adjusted under 35 U.S.C. 154(b) by 0 days.

(21) Appl. No.: 12/234,941

(22) Filed: Sep. 22, 2008

(51) Int. Cl.
*H01J 5/48* (2006.01)
*H01J 5/50* (2006.01)

(52) U.S. Cl. ..... 313/318.1; 362/654

(58) Field of Classification Search ..... 313/318.01, 313/318.09, 318.1; 362/654, 653, 249.06, 362/249.16, 806; 200/51 R, 51.1
See application file for complete search history.

(56) References Cited

U.S. PATENT DOCUMENTS 1,536,332 A 5/1925 Dam
5,139,343 A 8/1992 Lin
6,533,437 B1 * 3/2003 Ahroni ..... 362/249.12
6,609,814 B2 8/2003 Ahroni
6,764,205 B2 7/2004 Peloquin
7,186,017 B2 3/2007 Kuo
7,264,392 B2 9/2007 Massabki et al.
2004/0142494 A1 7/2004 Sheppard et al.
2006/0274556 A1 * 12/2006 Massabki et al. ..... 362/652
2007/0297196 A1 12/2007 Massabki et al.

* cited by examiner

*Primary Examiner*—Peter Macchiarolo
(74) *Attorney, Agent, or Firm*—Michael A. Mann; Nexsen Pruet, LLC

(57) ABSTRACT

An asymmetrical shunt switch for use in a socket of a string of lights resides in an otherwise typical lamp of a string of lights. The present switch is a shaped spring held in position between the two conducting terminals by a holder so that both of its lateral sides contact the terminals when the base is removed. When the base is inserted, a depending prong on the bottom corner of the base presses one side of the shaped spring away from its terminal and thereby allows current to flow through the Dumet wires to the filament.

9 Claims, 4 Drawing Sheets

ASYMMETRIC MECHANICAL SHUNT SWITCH FOR USE IN A SOCKET OF A STRING OF LIGHTS

CROSS REFERENCE TO RELATED PATENTS

N/A

BACKGROUND OF THE INVENTION

The present invention relates to light strings such as are used for holiday lighting.

Strings of lights are typically wired electrically in series. Consequently, when one light in the string burns out or is removed, all the lights in the string go out. Determining which light needs to be replaced is tedious. If the string has 50 or more lights and the string is attached to a Christmas tree, finding the burned out or missing bulb can be quite a task.

For a number of years, this problem has been solved, or at least avoided, by the use of shunts that allow current to pass directly between the terminals of the defective lamp, bypassing the missing or defective bulb filament. Passing electrical current from one lamp to the next regardless of the condition of the bulb in any individual lamp allows the remaining lamps to continue to operate.

Shunts are typically found in two places in prior art lamps, namely, in the glass globe and in the socket. The shunts inside the glass globe are typically coils of wire wrapped around the conductive elements (called Dumet wires). When the filament fails, the oxide coating on the wires that theretofore prevented direct conduction of electricity is burned off and the coil welds itself to the Dumet wires, thereby providing a new electrically conductive path for passing the electrical current.

Of the two types of shunts that are located in the socket, there are two types, namely, solid state shunts and mechanical shunts. Among the mechanical shunts, for example, there is a set of spring contact terminals that is the subject of U.S. Pat. No. 6,257,740. These spring contacts are pushed apart when the lamp base is inserted into the socket and spring back together when the base is removed, thereby allowing the current to pass from one terminal to the other directly. This type is strictly for use when the bulb (and its base) is removed and does not address the issue of a burned out bulb. This type of shunt works well and has enjoyed commercial success.

Another mechanical shunt is disclosed in U.S. Pat. No. 7,253,556, which is invented by one of the present inventors and is commonly owned by applicant. This mechanical shunt is a nearly horizontal flat strip of metal held in place between the two electrical terminals in a light socket by a shunt holder. The lateral ends of the shunt extend laterally and slightly downwardly to engage the electrical terminals on the socket wall. When the lamp base, which is hollow, is inserted into the socket, the shunt holder together with its shunt is received inside the hollow base, and, as the shunt enters the base, its lateral ends are bent down and away from the electrical terminals, thereby allowing electrical current to pass to and through the Dumet wires and thence to the filament in the bulb rather than directly through the shunt.

There are a huge number of light strings manufactured and sold each year throughout the world. The number is so large that even small changes that, for example, reduce material requirements, simplify manufacturing, or improve safety or reliability, make a huge difference in the costs to manufacture. Accordingly, there remains a need for a better mechanical shunt for use in the sockets of the lamps of light strings.

SUMMARY OF THE INVENTION

According to its major aspects and briefly recited, the present invention is an asymmetrical mechanical shunt switch for use in a socket of a string of lights. The switch redirects the current flow from passing through the filament to passing directly to the next light in the string of lights when the light and base are removed from the socket. The present shunt switch resides in an otherwise typical-looking lamp socket of a string of lights having plural lamps electrically interconnected in series by insulated, conductive wires. Each lamp has a bulb with a coiled filament running between a pair of terminals. These terminals, called Dumet wires, extend from the inside the bulb to the to the outside. The bulb is secured to a base and the Dumet wires extend through spaced-apart holes formed in the base. Once they emerge from the holes in the base, the Dumet wires are bent back against the outside of the base. The base is removably insertable into a socket that has two electrical terminals mounted opposite each other on the interior of the socket wall. When the base is properly inserted, the Dumet wires on the outside of the base contact the two electrical terminals in the wall of the socket and then pass current from those electrical terminals to the filament inside the bulb. These electrical terminals are attached to insulated wires entering the bottom of socket and coming from the adjacent lamps in the light string. Two alternative paths for the electrical current are thus created depending on whether the light and base are in the socket or not. The first runs from the first of the two insulated wires to the first of the two electrical terminals and thence to the first of two Dumet wires and the filament, returning through the second of the two Dumet wires, the second of the electrical terminals and finally to the second insulated wire. When the light has been removed, the first electrical terminal rather than being able to pass the current to the first Dumet wire, passes it to the shunt switch which passes it to the second electrical terminal and then to the second insulated wire.

The present switch is a resilient, shaped spring that is held securely by an offset, asymmtrical switch holder with a shaped head. The combination of the spring and the holder then forms an asymmetric shunt switch. The shunt switch is placed in position inside a socket of a lamp between the two conducting electrical terminals on the socket wall. One end of the spring is in constant contact with one of the electrical terminals, and the other, opposing end of the shaped spring is only in contact with the other electrical terminal when the base of the lamp is not in the socket. As the base is inserted, a triangular-shaped prong or tooth on the bottom corner of the base bends that end of the spring down and away from its electrical terminal, thereby breaking electrical contact between that one end of the spring and the electrical terminal it had been in electrical contact with. The other end of the spring remains in contact with its terminal, but the electrical circuit is nonetheless opened. When the base is removed, the tooth is lifted along with the removal of the lamp base, and the end of the shunt switch resiliently returns to a position of electrical contact with the electrical terminal, so that electrical power once again flows through the shunt switch and the remaining lights in the series circuit will continue to burn notwithstanding the removal of the bulb and base.

An important advantage of the present invention is that compared to prior art mechanical shunts that deflect bilaterally or have asymmetric springs held by symmetric holders, in the present invention, only one deflecting tooth is needed to break the circuit through the shunt switch rather than two. Thus, the spring functions as a switch with greater reliability than prior art switches and mechanical shunts. Furthermore, assembly of the present lamp is simplified because the shaped spring fits into a correspondingly-shaped off-set slot of the asymmetric holder to yield the asymmetric switch. Finally less material is used particularly on the base to interrupt the circuit. Given the huge volumes of lighting strings manufactured every year, increases in reliability, ease of manufacture, and reduction of material, however minor in terms of an individual light, can be collectively enormous.

These and other features and their advantages will be apparent to those skilled in the art of light string electrical design from a careful reading of the Detailed Description of Preferred Embodiments accompanied by the following drawings.

DETAILED DESCRIPTION OF THE INVENTION

The present invention is a lamp with a mechanical shunt switch for use as part of a string of lights. The switch shifts, or shunts, the flow of the electrical current from a path leading from one electrical terminal in the socket to the filament in the bulb to a path leading directly to the opposing electrical terminal and on to the next lamp in the series when the bulb and its base are removed from the socket. The term "light string" refers to plural spaced-apart lamps interconnected in series by insulated electrical wiring. The term "lamp" refers to the combination of a bulb in a base inserted into a socket.

Figure 1:
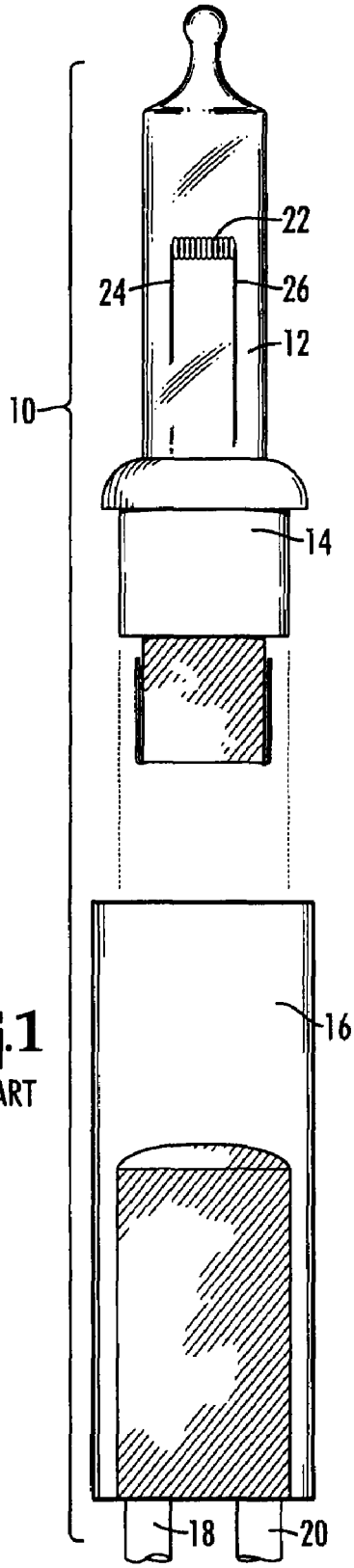
FIG.1 PRIOR ART
FIG. 1 is a side view of a prior art socket and lamp with the lamp shown pulled free of the socket.

FIG. 1 illustrates a prior art lamp, generally referred to as lamp 10, in a side view. Lamp 10 includes a bulb 12, a base 14 and a socket 16. In FIG. 1, bulb 12 and base 14 are shown lifted out of socket 16, whereas, in normal operation, bulb 12 and base 14 are seated in socket 16. Two insulated electrical wires 18, 20 extend from socket 16 and are connected to the adjacent lamps in the series of lamps of the light string (not shown). Bulb 12 is a partially evacuated transparent glass housing with a coiled filament 22 connected between a pair of Dumet wires 24, 26. Dumet wires 24, 26 extend from the interior of bulb 12 to its exterior. Base 14 holds bulb 16 and also has two holes formed therein through which Dumet wires 24, 26 pass. Once outside base 14, Dumet wires 24, 26 are folded back against the sides of base 14 in order to make contact with the electrical terminals (not shown) in socket 16.

Figure 2:
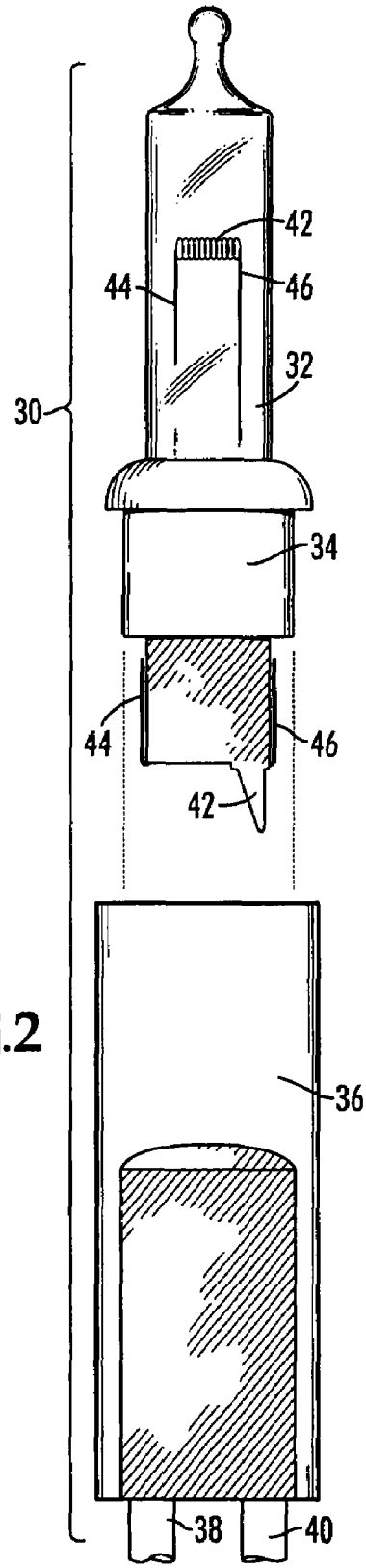
FIG. 2 is an equivalent side view of the present switching socket with the lamp shown pulled free of the socket to show the triangular-shaped prong, according to a preferred embodiment of the present invention.

FIG. 2 illustrates a side view of the present lamp 30 equivalent to that of the prior art lamp 10 of FIG. 1. Lamp 30 also contains a bulb 32, a base 34, and a socket 36. Two insulated electrical wires 38, 40 extend from socket 16 and run to the adjacent lamps in the series of lamps of the light string (not shown). Lamp 30 has a filament 42 between two Dumet wires 44, 46 inside bulb 32 that extend from inside bulb 32 through holes formed in base 34 to the exterior of base 34 where they are also folded back against base 34, just as in the case of Dumet wires 24, 26 being folded against the outside of base 14 of lamp 10.

Socket 36 is slightly longer than socket 16. For example, socket 36 may be 24 mm compared to a typical 18 mm socket 16. Another difference evident by comparing FIG. 1 to FIG. 2 is the triangular-shaped tooth 42 on the bottom corner of base 34, the function of which will be described presently.

Figure 3:
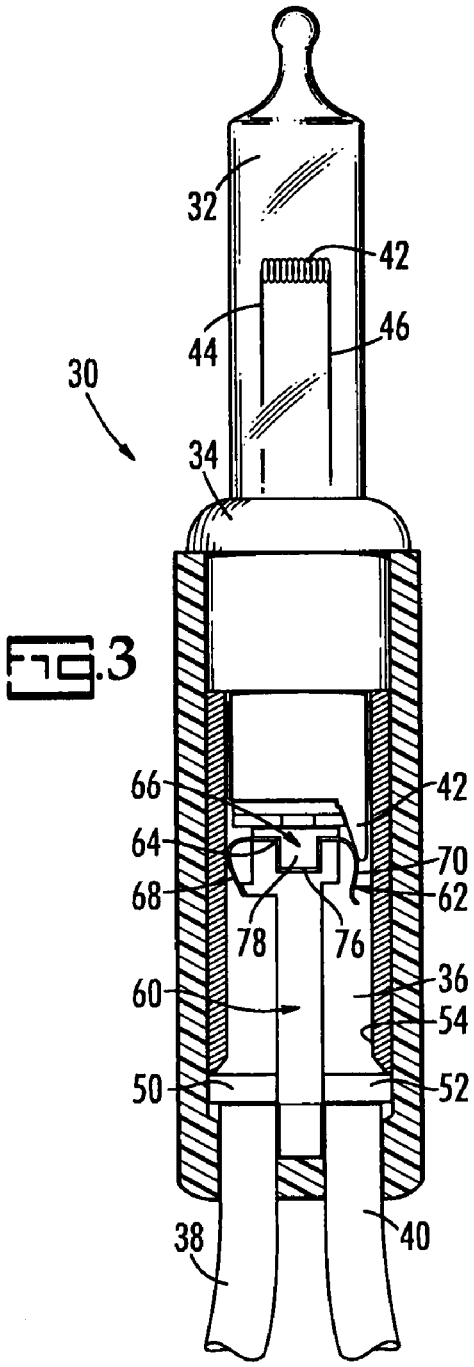
FIG. 3 is a cross-sectional view of the present lamp showing the base seated in the socket and with its tooth interacting with the switch in its holder to prevent passage of current through the shunt switch, according to a preferred embodiment of the present invention.
Figure 4:
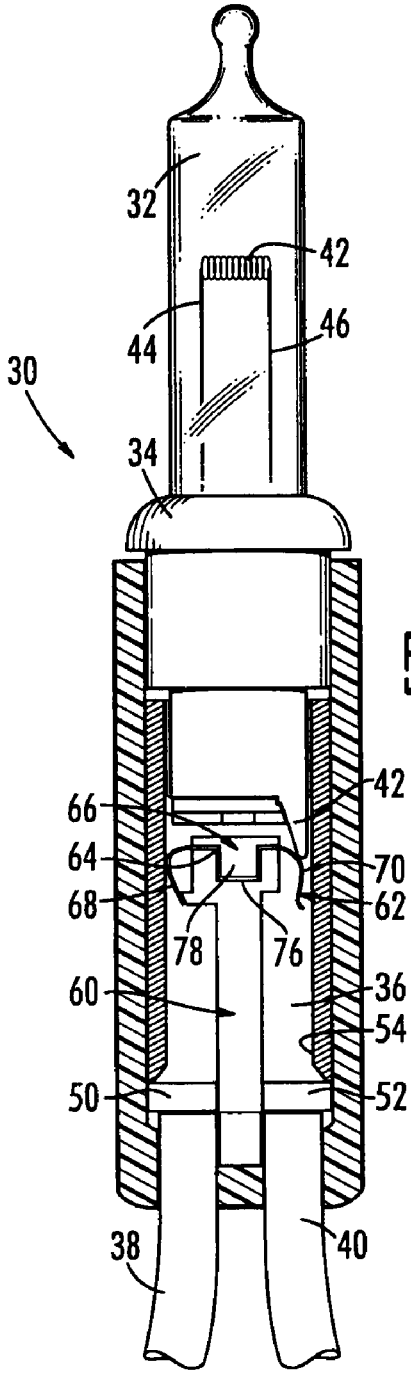
FIG. 4 is another cross-sectional view of the present lamp showing the base partially removed from the socket and with its tooth just barely preventing the shunt switch in its holder from allowing passage of current through the switch, according to a preferred embodiment of the present invention.
Figure 5:
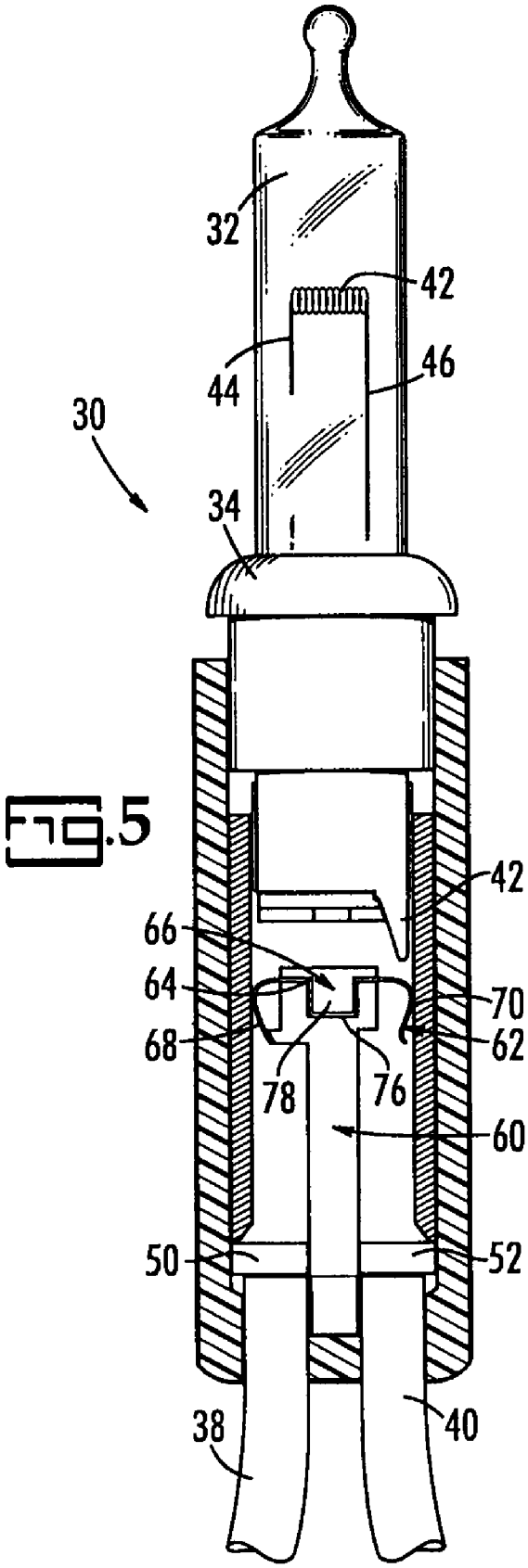
FIG. 5 is another cross-sectional view of the present lamp showing the base nearly removed from the socket and with its tooth no longer interacting with the shunt switch in its holder and thereby now allowing passage of current through the switch, according to a preferred embodiment of the present invention.

FIGS. 3, 4 and 5 show equivalent side views of the present lamp 30 with socket 36 shown in cross-section so that the details of its construction are apparent. Wires 38, 40 are connected to a first and an opposing second electrical terminal 50, 52, respectively, which are mounted to opposing sides of the interior wall 54 of socket 36 in opposing relation. A switch 60 is located inside socket 36, mounted between first and second terminals 50, 52. Switch 60 has an electrically conductive, shaped, resilient spring 62 inserted into a shaped channel formed in its head 66. Shaped spring 62 has a curved first end 68 and an opposing, curved, second end 70.

Head 66 is formed so that curved first end 68 cannot move appreciably but is held in electrically conductive engagement with first terminal 50 at all times. In contrast, second curved end 70 is relatively free to be deformed or bent, that is, its radius of curvature can be decreased at some point along its curve, but it is sufficiently resilient so that after a bending force is removed, second curved end 70 returns to its un-bent curve.

Figure 7:
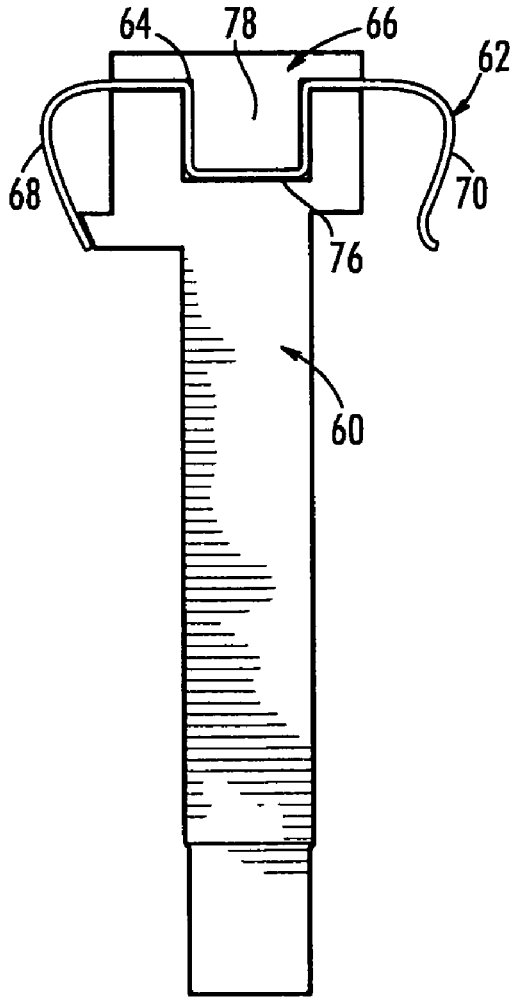
FIG. 7 is a detailed view of the holder of the present shunt switch, according to a preferred embodiment of the present invention.

Shaped spring 62 has a locking curve 76 formed therein that corresponds to a keyed portion 78 of head 66. See FIG. 7. Locking curve 76 helps to hold shaped spring 62 in place so that it does not shift toward either terminal. Note that shaped spring 62 is inserted into channel 76 in an offset head 66 and that locking curve 76 is off-set with respect to head 66 in the opposing direction, so that shaped spring 62 is centered between first and second electrical terminals 50, 52, but bending of first curved end 68 is restricted compared to second curved end 70. Note also that holder 60 can be inserted into socket 36 with second curved end 70 to the left or right without difficulty and that head 66 of holder 60 has a brace 82 to help first curved end 68 resist deflection away from first terminal 50.

FIG. 3 shows base 34 fully seated in socket 36. FIG. 4 shows base 34 partially removed from socket 36. FIG. 5 shows base 34 sufficiently removed from socket 36 so that tooth 42 no longer bends second end 70 of shaped spring 62 to separate it from terminal 52. Consequently, second end 70 of shaped spring 62 engages second terminal 52 and shaped spring 62 can therefore pass electrical current it receives from first terminal 50 to second terminal 52 and not through filament 42. Because base 34 is sufficiently removed from socket 36, the Dumet wires 44, 46 folded outside of it are also no longer in contact with first and second terminals 50, 52, and, accordingly, no longer conducting electricity.

Figure 6:
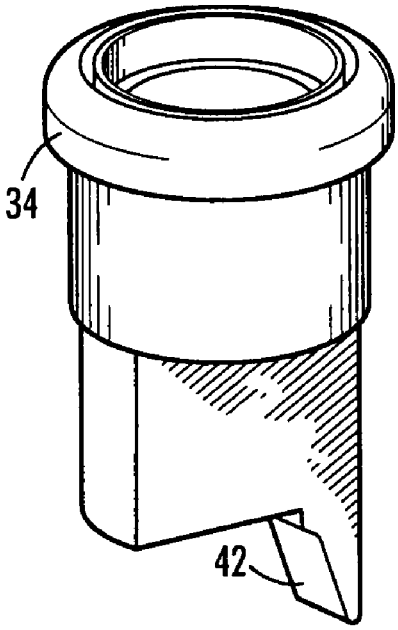
FIG. 6 is perspective view of the lamp base to show the triangular-shaped tooth, according to a preferred embodiment of the present invention.

Note that the geometric configuration of tooth 42 with respect to second end 70 of shaped spring 62 and the position of Dumet wires 44, 46, outside of base 34 with respect to terminals 50, 52 is critical: contact between Dumet wires 44, 46 and terminals 50, 52, respectively, must not be broken until contact between second end 70 and terminal 52 is established, and contact between second end 70 and terminal 52 must not be broken by prong 42 until contact between Dumet wires 44, 46, is re-established in order to prevent arcing. See FIG. 6. The shape and dimensions of tooth 42 determine when it engages second end 70 and how rapidly it bends second end 70 away from terminal 52. Tooth 42 must be short enough so that Dumet wires 44, 46, engage first and second terminals 50, 52 before it bends second end 70 of shaped spring 62 but tooth 42 must be sufficiently wide to sever contact between second end 70 and second terminal 52.

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art from the foregoing description of the preferred embodiments without departing from the spirit or scope of the present invention.

What is claimed is:

1. A lamp for use in a light string, said lamp comprising:

a bulb;

a filament in said bulb;

a base carrying said bulb, said base having two spaced-apart holes therethrough and a corner, said base having a tooth depending from said corner of said base;

a first and a second Dumet wires extending from said filament inside said bulb through said two spaced-apart holes in said base to the exterior of said base;

a socket carrying said base, said base removably seatable in said socket, said socket having an interior wall;

a first and an opposing second terminal carried by said interior wall of said socket, said first and said second Dumet wires engaging said first and said second terminals, respectively, when said base is seated in said socket;

an asymmetrical holder carried by said socket;

a conductive spring shunt carried by said holder and having a first curved end and an opposing second curved end, said first curved end being held by said asymmetrical holder in contact with said first terminal when said base is inserted into said socket and when said base is not inserted into said socket, said second curved end being held in contact with said second terminal only when said base is not inserted in said socket, but, when said base is inserted into said socket, said tooth of said base bends said second curved end away from said second terminal.

2. The lamp as recited in claim 1 wherein said tooth is triangular.

3. The lamp as recited in claim 1, wherein said asymmetrical holder has a curved channel formed therein and said spring is curved to fit into said curved channel.

4. The lamp as recited in claim 1, wherein said asymmetrical holder has a head with a channel being formed in said head, said channel being positioned within said head so that said first curved end of said shaped spring extends from said head less than said second curved end extends from said head.

5. The lamp as recited in claim 4, wherein said channel is curved and said spring is curved to fit within said channel.

6. The lamp as recited in claim 5, wherein said head of said asymmetrical holder is off-set so that said shunt is asymmetrical.

7. The lamp as recited in claim 1, wherein said tooth is dimensioned so that, when said base is inserted into said socket, after said first and said second Dumet wires make contact with said first and second terminals, respectively, said tooth bends said second curved end of said shunt away from said second terminal.

8. The lamp as recited in claim 1, wherein said tooth is dimensioned so that, when said base is removed from said socket, before said first and said second Dumet wires break contact from said first and said second terminals, said tooth releases said second curved end of said shunt to engage said second terminal.

9. The lamp as recited in claim 1, wherein a head of said asymmetric holder carries a brace to help said first curved end resist deflection.

* * * * *